US008590187B2

(12) United States Patent
Kroon et al.

(10) Patent No.: US 8,590,187 B2
(45) Date of Patent: Nov. 26, 2013

(54) DISPLAY DEVICE WITH REMOVABLE CASSETTE

(75) Inventors: Mats Gunnar Henrik Kroon, Anderstorp (SE); Thomas Valeij, Huddinge (SE); Christer Zarelius, Stockholm (SE); Jari Kekkonen, Tullinge (SE)

(73) Assignee: Expand International AB, Johanneshov (SE)

( * ) Notice: Subject to any disclaimer, the term of this patent is extended or adjusted under 35 U.S.C. 154(b) by 106 days.

(21) Appl. No.: 13/047,141

(22) Filed: Mar. 14, 2011

(65) Prior Publication Data

US 2011/0219652 A1 Sep. 15, 2011

Related U.S. Application Data

(60) Provisional application No. 61/313,843, filed on Mar. 15, 2010.

(51) Int. Cl.
*G09F 15/00* (2006.01)

(52) U.S. Cl.
USPC ..... 40/610; 160/24

(58) Field of Classification Search
USPC ..... 40/610, 514, 116, 385, 515, 517; 160/24; 362/461; 359/461
See application file for complete search history.

(56) References Cited

U.S. PATENT DOCUMENTS

| | | | | |
|---|---|---|---|---|
| 1,443,695 | A * | 1/1923 | McKibbin | 160/24 |
| 2,589,609 | A * | 3/1952 | Foster | 160/23.1 |
| 4,627,210 | A * | 12/1986 | Beaulieu | 52/646 |
| 5,581,401 | A * | 12/1996 | Takamoto et al. | 359/443 |
| 6,038,800 | A * | 3/2000 | Seidel | 40/517 |
| 6,571,496 | B2 | 6/2003 | Zarelius | |
| 6,643,966 | B2 * | 11/2003 | Schmitt | 40/610 |
| 6,991,019 | B2 * | 1/2006 | Chang | 160/24 |
| 2002/0050083 | A1 | 5/2002 | Zarelius | |
| 2008/0005945 | A1 | 1/2008 | Fritsche et al. | |
| 2010/0050489 | A1 | 3/2010 | Merner et al. | |
| 2010/0180481 | A1 * | 7/2010 | Parizek et al. | 40/610 |

OTHER PUBLICATIONS

International Search Report issued on Sep. 13, 2010 in European Application No. 1050234-2 filed Mar. 15, 2010.

* cited by examiner

*Primary Examiner* — Kristina Junge
(74) *Attorney, Agent, or Firm* — Drinker Biddle & Reath LLP

(57) ABSTRACT

A display device including a stand adapted to display a screen. The stand includes a holding member with a first side adapted to support against an underlying supportive surface. The display device also includes a cassette including a bobbin enclosed in a cavity in the cassette, wherein the screen can be wound onto and withdrawn from the bobbin. The cassette is being adapted to be inserted into and removed from the holding member via an aperture in the first side. The holding member also includes at least one fastener adapted to fasten the cassette in the holding member when inserted into the holding member.

20 Claims, 17 Drawing Sheets

DISPLAY DEVICE WITH REMOVABLE CASSETTE

RELATED APPLICATION DATA

This application claims priority under 35 U.S.C. §119(e) to U.S. Provisional Application No. 61/313,843 filed on Mar. 15, 2010, the entire contents of which are incorporated herein by reference

FIELD

The present invention relates to a display means with a removable cassette.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

The patent document U.S. Pat. No. 6,571,496 relates to a portable visual display device with removable cassette. The visual display device has a holding member, and the cassette can be removable inserted into and removed from the holding member. This is done from the end of the holding member. The screws holding the outer end cap on one side are removed. Thereafter, the outer end cap is removed. Finally, the cassette slides out.

This solution has some general advantages. It gives a relatively easy way of replacing the cassette. The end customer/user of the display device can have one display device with several cassettes and rapidly change the print. But still it is possible to improve this solution even more.

SUMMARY

The above mentioned objects are achieved with a display means according to claim 1. The display means comprises a stand adapted to display a screen, wherein the stand comprises a holding means with a first side adapted to support against an underlying supportive surface. The display means also comprises a cassette comprising a bobbin enclosed in a cavity in the cassette, wherein the screen can be wound onto and withdrawn from the bobbin. The cassette is adapted to be inserted into and removed from the holding means via an aperture in the first side. The holding means also comprises at least one fastening means adapted to fasten the cassette in the holding means when inserted into the holding means.

An advantage with this solution is that it is very fast to remove the cassette. A further advantage is that it does not use any screws, that risks being misplaced. Furthermore, it is very fast to put a new cassette back in place. A still further advantage with this solution is that, if desired, the screen can be changed with the cassette in the display means. This cannot be done with the solution presented in U.S. Pat. No. 6,571,496. For end users it is easier to operate the cassette and therefore to make use of a replacement system.

A further advantage in this context is achieved if the fastening means is in the form of holders arranged essentially perpendicular in relation to the lengthwise direction of the aperture, and the cassette when inserted into the holding means, and if the holding means also comprises lock tabs adapted to cooperate with the holders in fastening the cassette in the holding means.

Furthermore, it is an advantage in this context if the holders at least in part have a shape complementary to the shape of a part of the cassette.

A further advantage in this context is achieved if the cassette has a cylindrical shape.

Furthermore, it is an advantage in this context if each of the holders at a first end is secured to the holding means via a hinge means, and at a second end cooperates with the lock tabs in fastening the cassette in the holding means.

A further advantage in this context is achieved if each display means comprises two holders.

Furthermore, it is an advantage in this context if each display means also comprises two end caps arranged perpendicular in relation to the lengthwise direction of the holding means, and each covering an end side of the holding means.

A further advantage in this context is achieved if at least one of the end caps functions as the fastening means in that it is a removable end cap adapted to partly cover the cassette inserted into the holding means, when the end cap is arranged on the end side.

Furthermore, it is an advantage in this context if the removable end cap is arranged on, and removed from the end side by means of snap joint means arranged on the holding means.

According to another embodiment it is an advantage if the removable end cap is arranged on, and removed from the end side by means of bayonet joint means arranged on the holding means.

According to yet another embodiment it is an advantage if each fastening means is in the form of a band adapted to strap the cassette into the holding means.

A further advantage in this context is achieved if the band is fastened to the holding means by means of a turning knob.

According to another embodiment it is an advantage if the band is fastened to the holding means by means of Velcro® tape.

Furthermore, it is an advantage in this context if the cassette also comprises two end caps arranged perpendicular in relation to the lengthwise direction of the cassette, and each covering an end side of the cassette.

A further advantage in this context is achieved if the fastening means is in the form of a lock plunger means provided on at least one of the end caps, and an actuator means operable to actuate the lock plunger means between a first, inactive state, wherein the lock plunger means is in line with the end cap, and a second, active state, wherein the lock plunger means protrudes from the end cap, and fits in a recess provided in the end cap.

According to another embodiment it is an advantage if the fastening means is in the form of a lock plunger means provided on at least one end cap, and an actuator means operable to actuate the lock plunger means between a first, inactive state, wherein the lock plunger means is in line with the end cap, and a second, active state, wherein the lock plunger means protrudes from the end cap, and fits in a recess provided in the end cap of the cassette.

According to yet another embodiment it is an advantage if the fastening means is in the form of an L shaped slot provided on at least one of the end caps of the cassette, and a protrusion means provided on the end cap, and facing towards the aperture in the holding means, wherein the protrusion means fits in the L shaped slot.

According to another embodiment it is an advantage if the fastening means is in the form of an L shaped slot provided on at least one of the end caps, and facing towards the aperture in the holding means, and a protrusion means provided on at least one of the end caps of the cassette, wherein the protrusion means fits in the L shaped slot.

According to yet another embodiment it is an advantage if the fastening means is in the form of a spring biased lock plunger means provided on the end cap, and facing towards the aperture in the holding means, and recess provided in the end cap of the cassette, wherein the spring biased lock plunger means is operable to fit in the recess when the lock plunger means being released.

According to another embodiment it is an advantage if the fastening means is in the form of a spring biased lock plunger means provided on the end cap of the cassette, and a recess provided in the end cap, and facing towards the aperture in the holding means, wherein the spring biased lock plunger means is operable to fit in the recess when the lock plunger means being released.

It will be noted that the term "comprises/comprising" as used in this description is intended to denote the presence of a given characteristic, step, or component, without excluding the presence of one or more other characteristic, features, integers, steps, components or groups thereof.

It is to be understood that both the foregoing general description and the following detailed description are exemplary and explanatory and are intended to provide further explanation of the invention as claimed.

BRIEF DESCRIPTION OF THE DRAWING

Embodiments of the invention will now be described with a reference to the accompanying drawings, in which.

DETAILED DESCRIPTION

Figure 1:
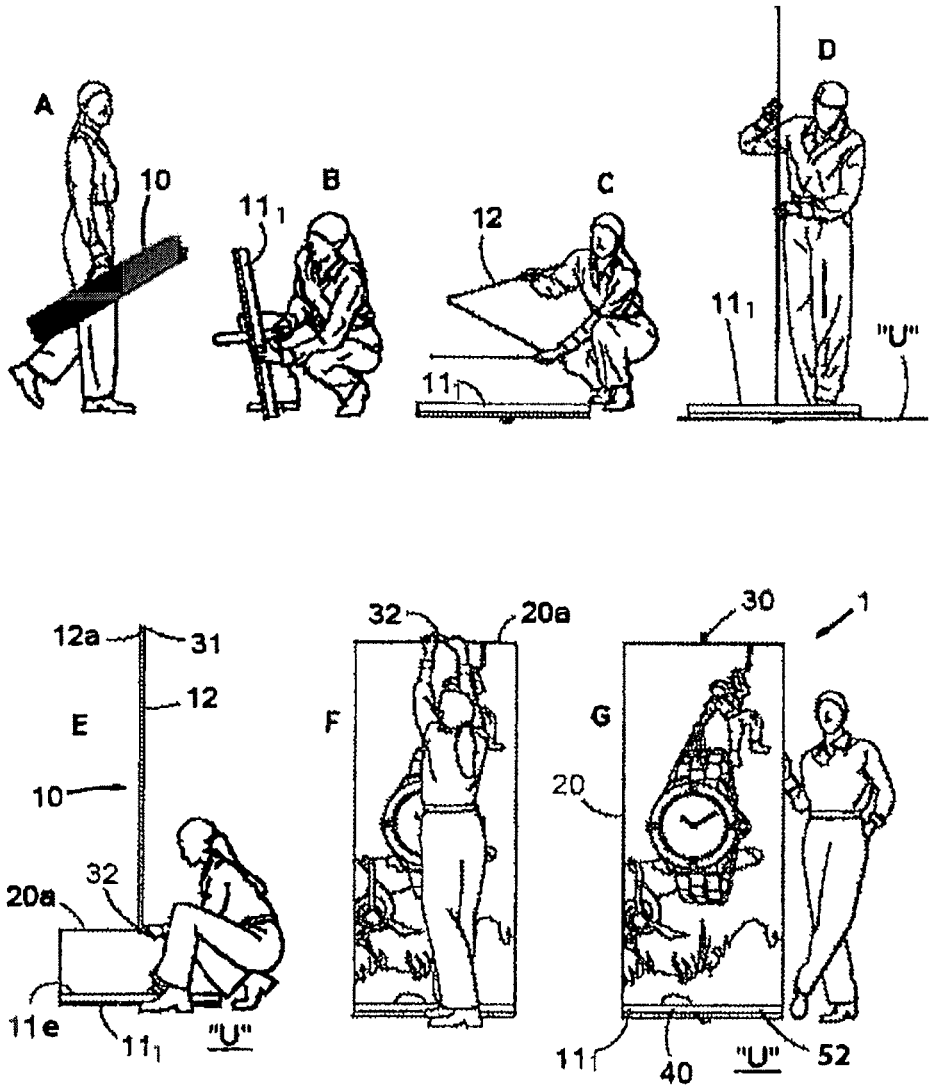
FIG. 1 illustrates assembly sequences A-G, applicable to a known display means.

In FIG. 1 there is disclosed a more or less complete assembly sequence with the aid of individual assembly steps referenced A-G of a display means 1, this assembly sequence or erection sequence also being applicable to the display means 1 according to the present invention.

According to step A, the display means 1 comprises a stand 10, which in a fully erected state (steps F, G) firmly supports a screen 20, wherein the stand 10 comprises a first side $\mathbf{11}_1$ which supports against an underlying supportive surface U (step D), and further includes a foldable part 12 which, when the stand 10 is erected, extends upwardly from the first side 111.

One upwardly extending end part 12*a* of the second part 12 (step E) has a first coupling element 31 included in a two-part coupling arrangement 30, wherewith the other coupling element 32 of the coupling arrangement is joined to the screen 20 either directly or indirectly, and orientated in connection with the upper edge part 20*a* of the screen 20.

The screen 20 can be wound onto and unwound from a bobbin 40 enclosed in a cavity (not shown) located in the first part 11, wherein the bobbin 40 can be actuated by a spring arrangement 52 that includes an associated spring unit.

The spring arrangement 52 is designed to act on the screen 20 with a decreasing force during a screen wind-up phase (the steps from F to E) with the aid of a spring unit consisting of helically twisted or wound metal wire, wherewith the screen 20 is acted upon at an increasing force during an unwinding phase (the steps from E to F).

The spring arrangement 52 is also adapted to act on the screen 20 with a chosen initial power when the screen 20 has been fully wound around the bobbin 40 (in accordance with the step D).

The first part 11 includes a slot IIe through which the screen 20 passes as to be unwound from or wound onto the bobbin 40 present in the cavity.

Figure 2:
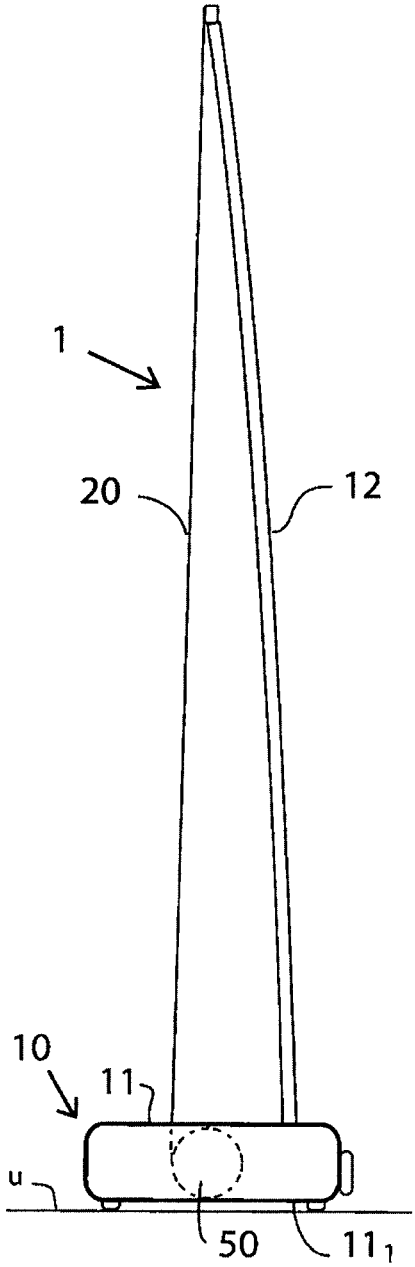
FIG. 2 is a side view of a display means 1 according to the present invention.

In FIG. 2 there is disclosed a side view of a display means 1 according to the present invention. The display means 1 comprises a stand 10 adapted to display a screen 20. The stand 10 comprises a holding means 11 with a first side $\mathbf{11}_1$ adapted to support against an underlying supportive surface (u). The display means 1 also comprises a cassette 50 comprising a bobbin 40 (not disclosed in FIG. 2) enclosed in a cavity in the cassette 50. The screen 20 can be wound onto and withdrawn from the bobbin 40. Furthermore, the display means 1 also comprises a pole means 12 operable to secure the screen 20 when it is at least partly withdrawn from the bobbin 40.

Figure 3:
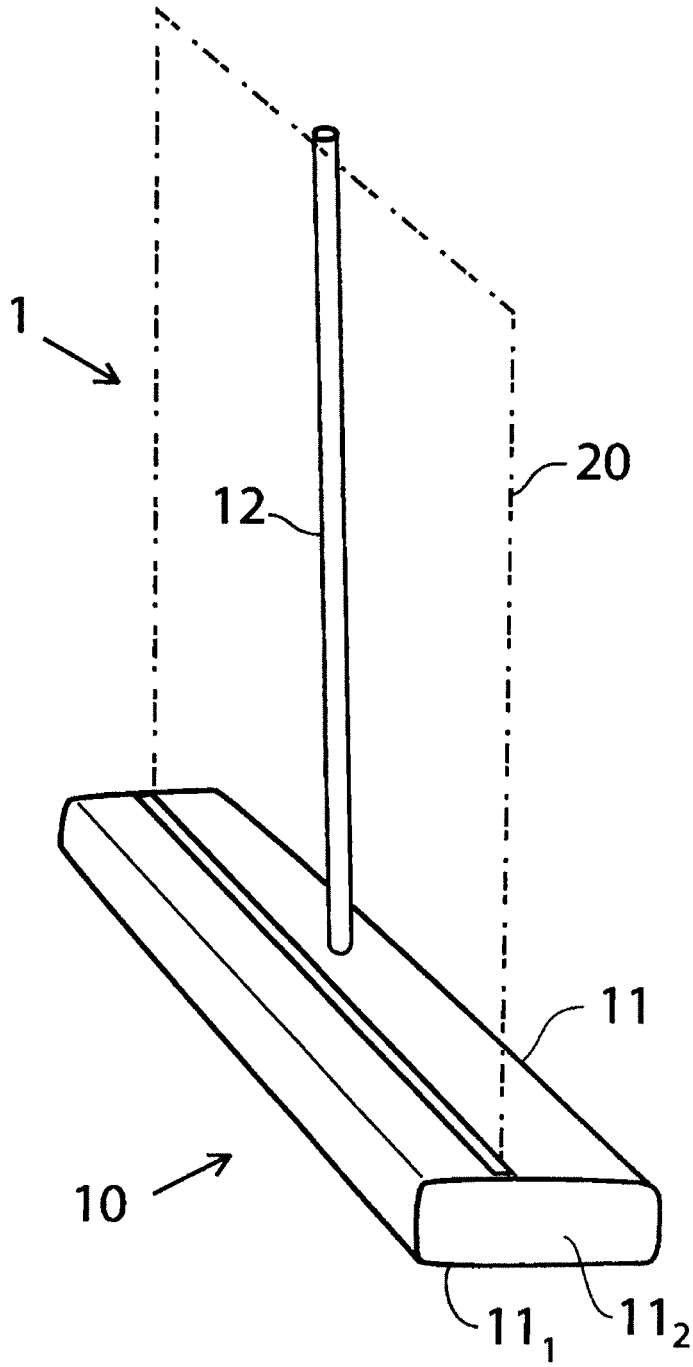
FIG. 3 is a perspective view of a display means 1 according to the present invention.

In FIG. 3 there is disclosed a perspective view of the display means 1 according to the present invention. The same elements in both FIGS. 2 and 3 are designated with the same reference signs and will not be described again. As is apparent in FIG. 3 the holding means 11 has two end sides 112.

Figure 4:
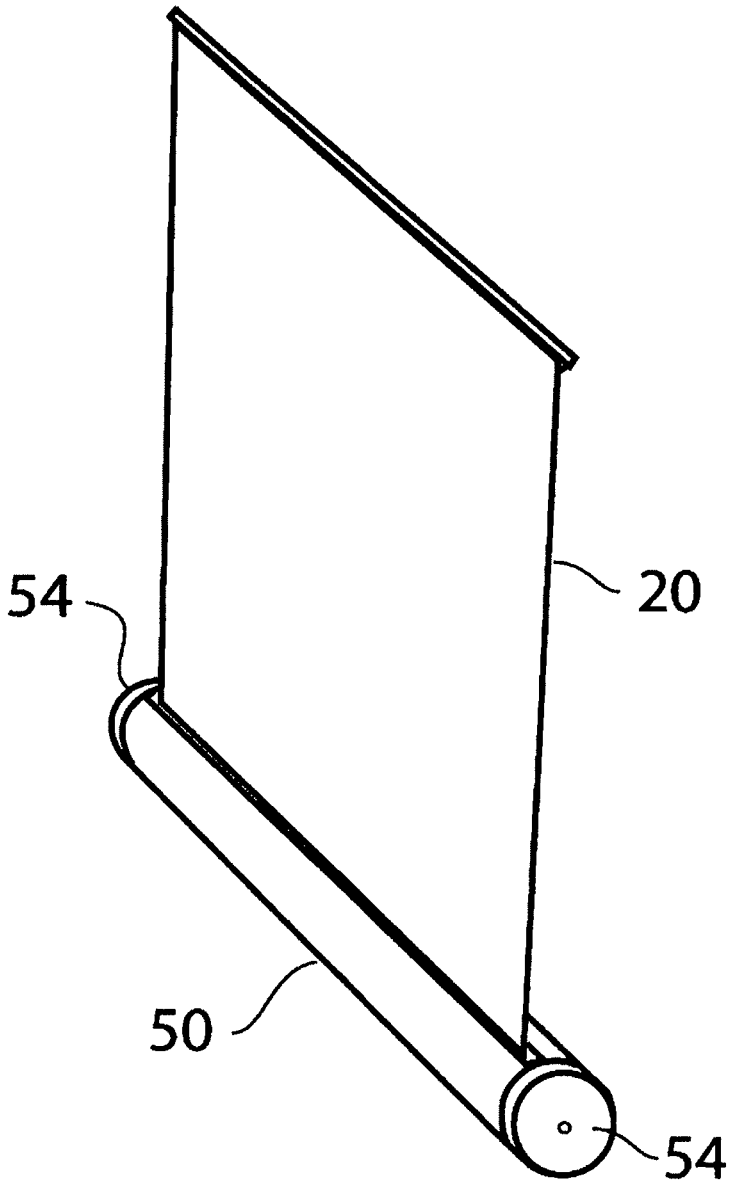
FIG. 4 is a perspective view of some parts of a display means 1 according to the present invention.

In FIG. 4 there is disclosed a perspective view of some parts of the display means 1 according to the present invention. In this figure the screen 20 has been withdrawn from the bobbin 40 (not disclosed) in the cassette 50. As is apparent in FIG. 4 the cassette 50 also comprises two end caps 54 arranged perpendicular in relation to the lengthwise direction of the cassette 50, and each covering an end side $\mathbf{50}_1$ of the cassette 50.

Figure 5:
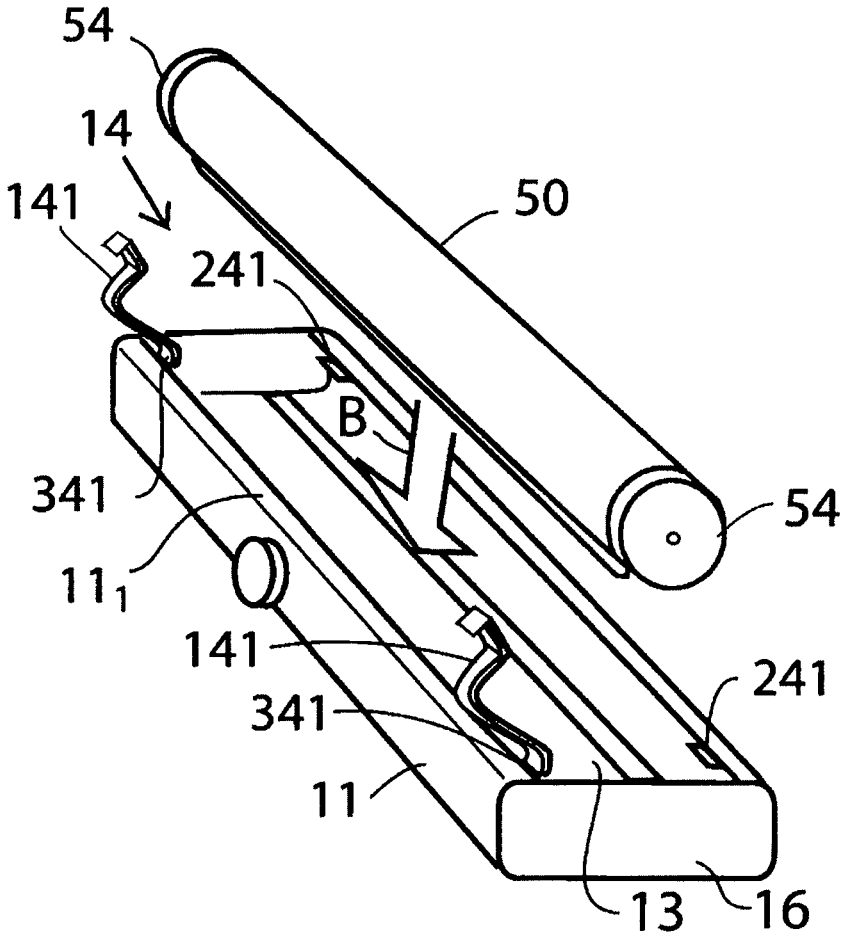
FIG. 5 is a perspective view of a first embodiment of the display means 1 according to the present invention.

In FIG. 5 there is disclosed a perspective view of a first embodiment of the display means 1 according to the present invention. Here the display means 1 is disclosed with the holding means 11 upside down, i.e. ready to change the cassette 50. It is also possible to see the aperture 13 in the first side $\mathbf{11}_1$ of the holding means 11. As is indicated with the arrow B in FIG. 5, the cassette 50 is to be inserted into the holding means 11 via the aperture 13. In this particular embodiment, the fastening means 14, there are disclosed two, are in the form of holders 141 arranged essentially perpendicular in relation to the lengthwise direction of the aperture 13, and lock tabs 241 arranged at the holding means 11. As is apparent in FIG. 5, each of the holders 141 is at a first end secured to the holding means 11 via a hinge means 341, meaning that the holders 141 can be arranged in a first, open state, as indicated in FIG. 5, where it is possible to change the cassette 50.

Figure 6:
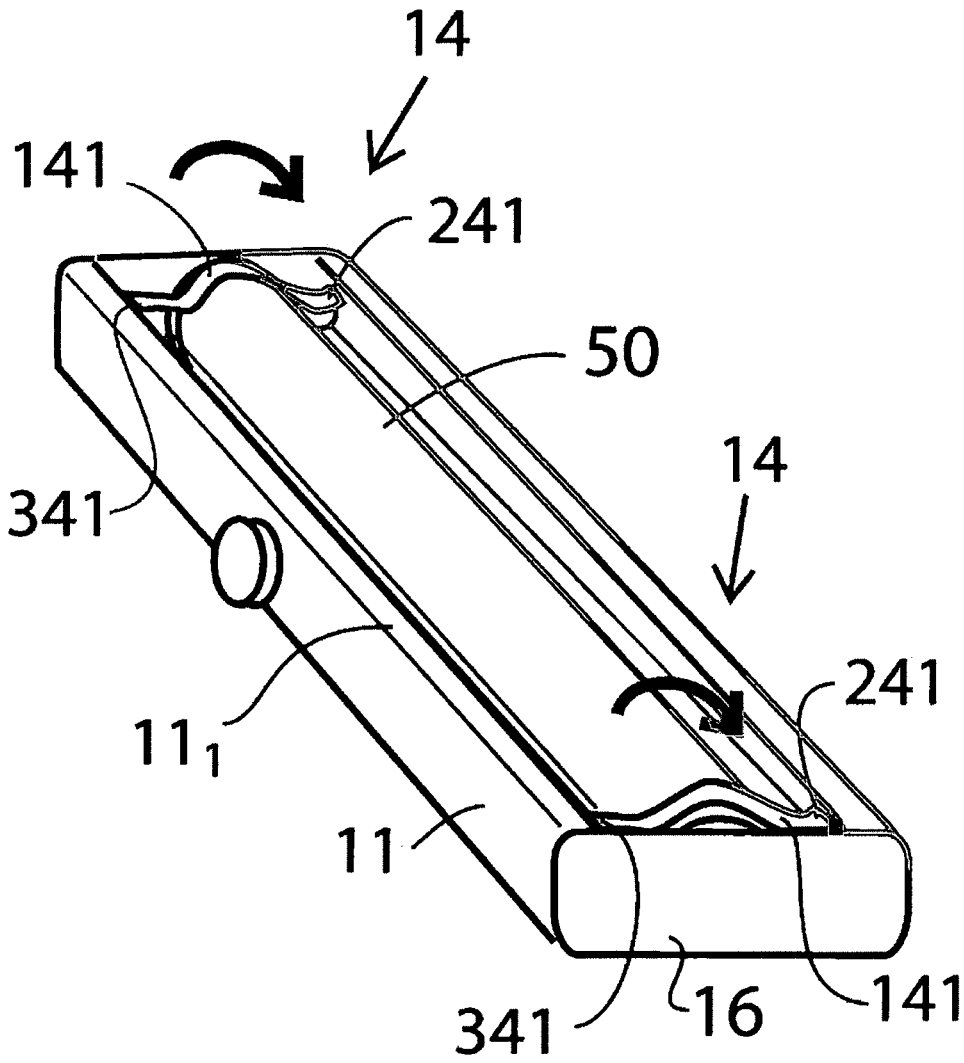
FIG. 6 is a perspective view of the first embodiment disclosed in FIG. 5.

In FIG. 6 there is disclosed a perspective view of the first embodiment disclosed in FIG. 5. Here the cassette 50 has been changed and inserted into the holding means 11. Furthermore, the holders 141 have been arranged in a second, locked state, wherein the holders 141 have been pivoted, indicated with the arrows in FIG. 6, and locked by the lock tabs 241. As also is apparent in FIGS. 5, and 6, the holders 141 have at least in part a shape complementary to the shape of a part of the cassette 50. In this particular embodiment the cassette 50 has a cylindrical shape. Furthermore, the display means 1 also comprises two end caps 16, each covering an end side $\mathbf{11}_2$ (see FIG. 7) of the holding means 11.

Figure 7:
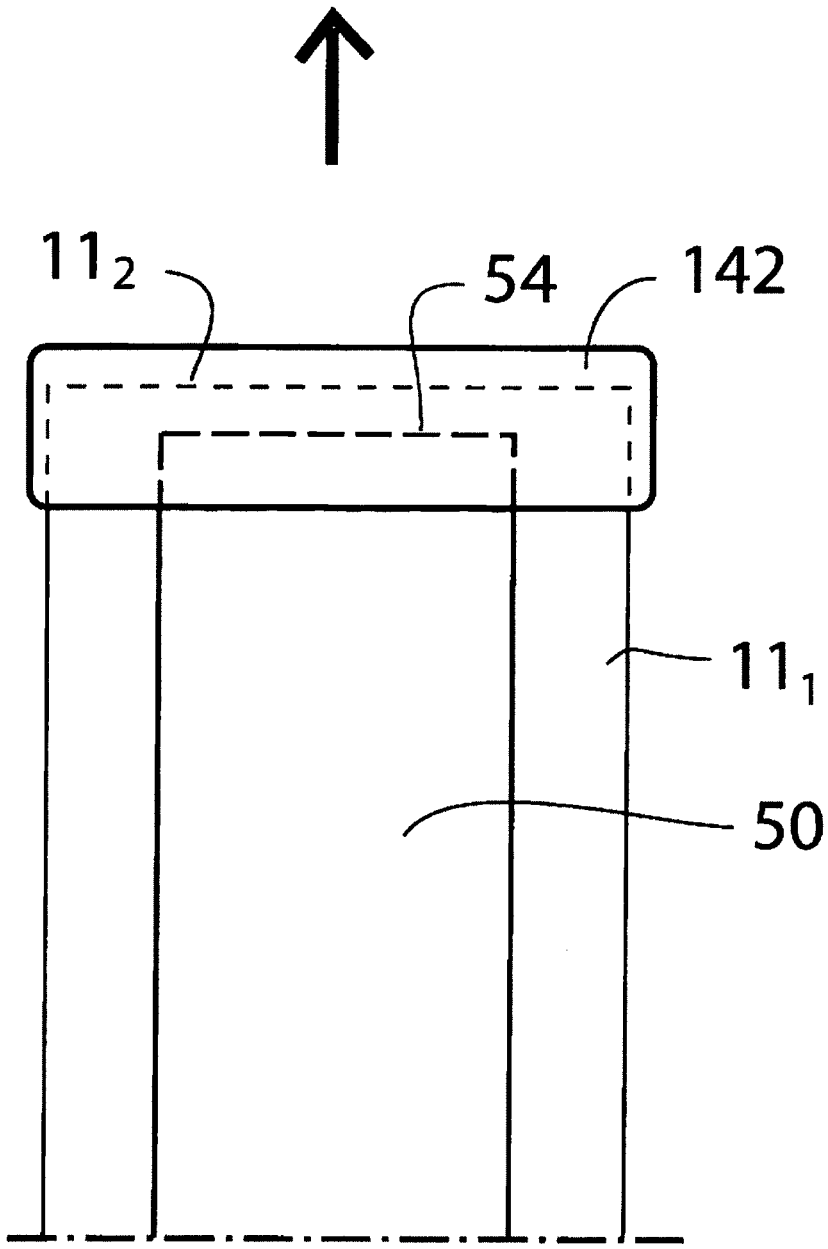
FIG. 7 is a side view of a second embodiment of the display means 1 according to the present invention.

In FIG. 7 there is disclosed a side view of a second embodiment of the display means 1 according to the present invention. Here the display means 1 is disclosed with the holding means 11 upside down, i.e. the first side $\mathbf{11}_1$ of the holding means 11 is disclosed. As is apparent in FIG. 7, the cassette 50 is inserted into the holding means 11. In this particular embodiment, at least one of the end caps 16 (see FIGS. 5, and 6) functions as the fastening means 14 in that it is a removable end cap 142 adapted to partly cover the cassette 50 inserted into the holding means 11, when the end cap 142 is arranged on the end side $\mathbf{11}_2$ of the holding means 11. The arrow disclosed in FIG. 7 indicates how the end cap 142 is removed when the cassette 50 is to be changed.

Figure 8:
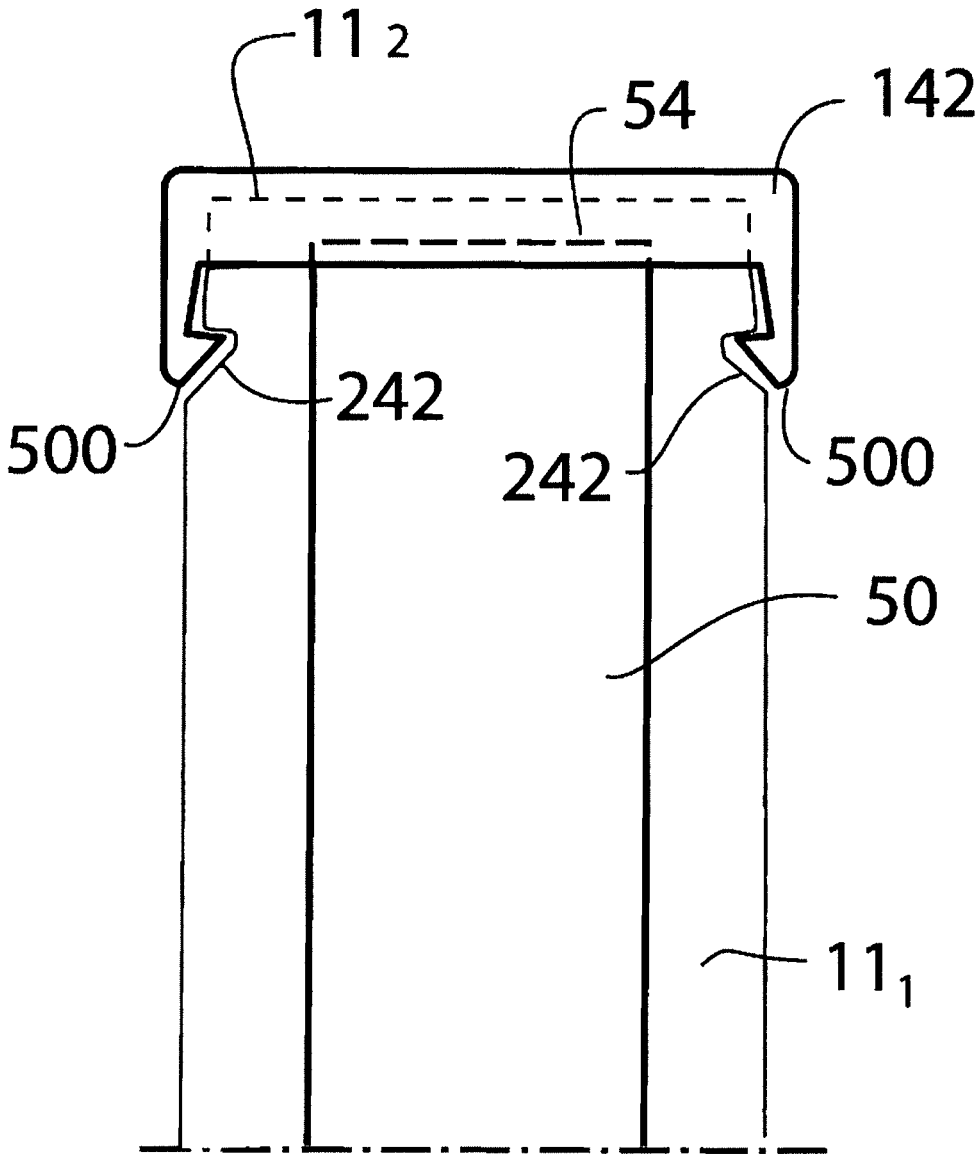
FIG. 8 is a side view of a third embodiment of the display means 1 according to the present invention.

In FIG. 8 there is disclosed a side view of a third embodiment of the display means 1 according to the present invention. In this particular embodiment, the fastening means 14 is a removable end cap 142. The end cap 142 is arranged on, and removed from the end side $\mathbf{11}_2$ of the holding means 11 by means of snap joint means 242, 500. As is apparent in FIG. 8, the snap joint means 242, 500 comprises a snap joint means 242 of female type arranged on the holding means 11, and a snap joint means 500 of male type arranged on the end cap 142. As is apparent in FIG. 8, the two snap joint means 242, 500 are mating each other, and the end cap 142 is adapted to partly cover the cassette 50 inserted into the holding means 11, when the end cap 142 is arranged on the end side $\mathbf{11}_2$ of the holding means 11.

Figure 9:
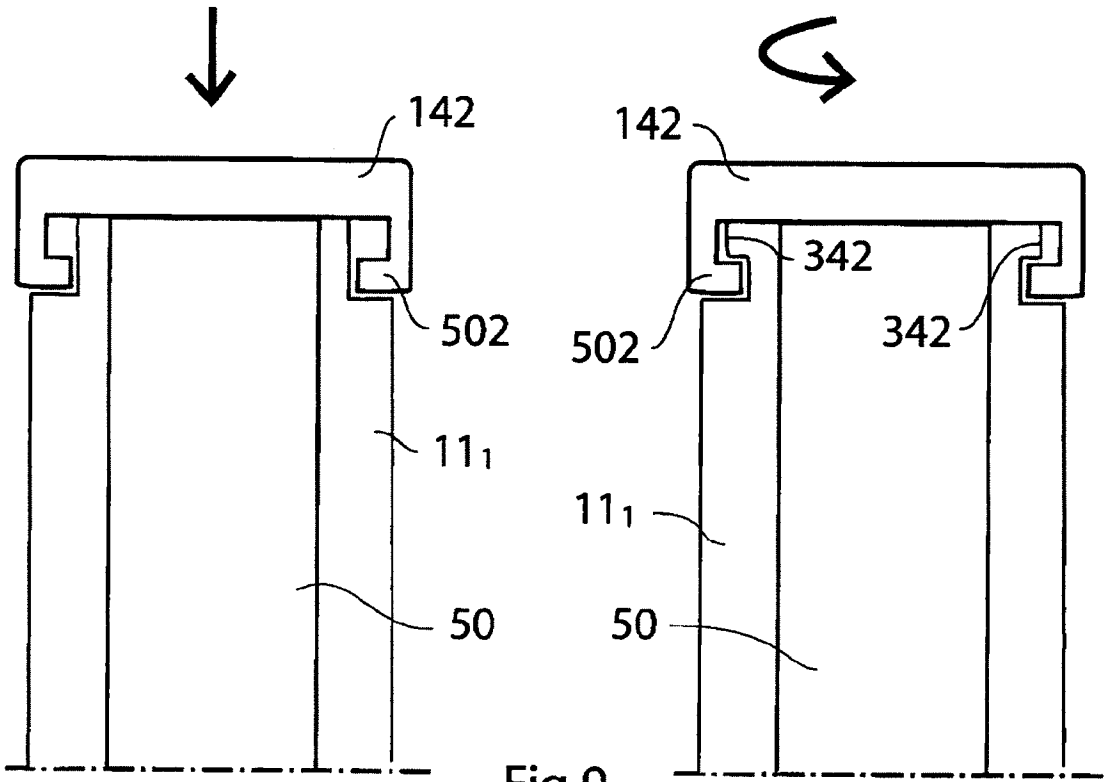
FIG. 9 discloses two side views of a fourth embodiment of the display means 1 according to the present invention.

In FIG. 9 there are disclosed two side views of a fourth embodiment of the display means 1 according to the present invention. In this particular embodiment, the fastening means 14 is a removable end cap 142. The end cap 142 is arranged on, and removed from the end side $\mathbf{11}_2$ of the holding means 11 by means of bayonet joint means 342, 502. As is apparent in FIG. 9, is one part 342 of the bayonet joint means 342, 502 arranged on the holding means 11, and the other part 502 of the bayonet joint means 342, 502 is arranged on the end cap 142. As indicated in FIG. 9, is the locking of the cassette 50 with the end cap 142 an operation with two steps. First, the end cap 142 is placed on the holding means 11, see the left side of FIG. 9. Thereafter, the end cap 142 is turned, see the right side of FIG. 9 and the arrow, so that the bayonet joint means 342, 502 are locking each other.

Figure 10:
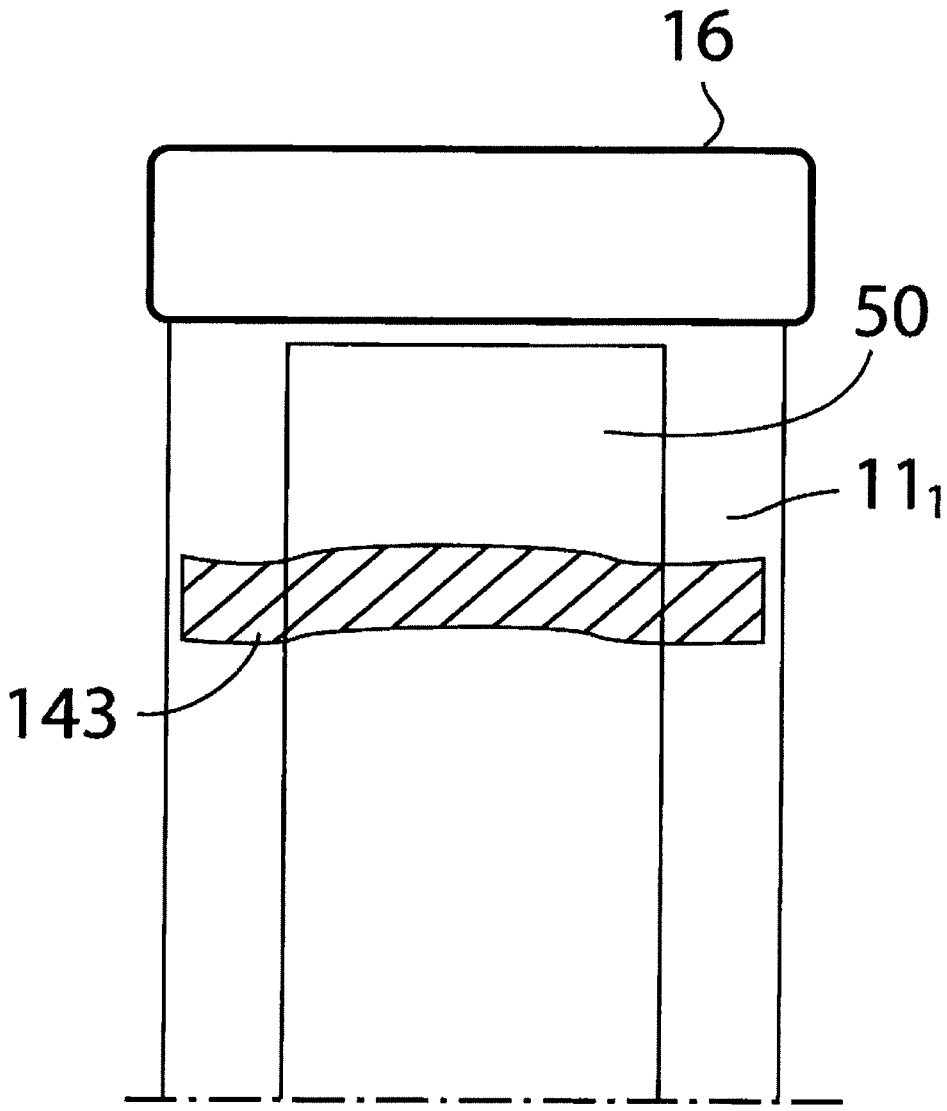
FIG. 10 is a side view of a fifth embodiment of the display means 1 according to the present invention.

In FIG. 10 there is disclosed a side view of a fifth embodiment of the display means 1 according to the present invention. Here the display means 1 is disclosed with the holding means 11 upside down, i.e. the first side $\mathbf{11}_1$ of the holding means 11 is disclosed. As is apparent in FIG. 10, the cassette 50 is inserted into the holding means 11. In this particular embodiment, the fastening means 14 is in the form of a band 143 adapted to strap the cassette 50 in the holding means 11. Although it is only disclosed one band 143 in FIG. 10, it is pointed out that it is possible to have several bands 143.

Figure 11:
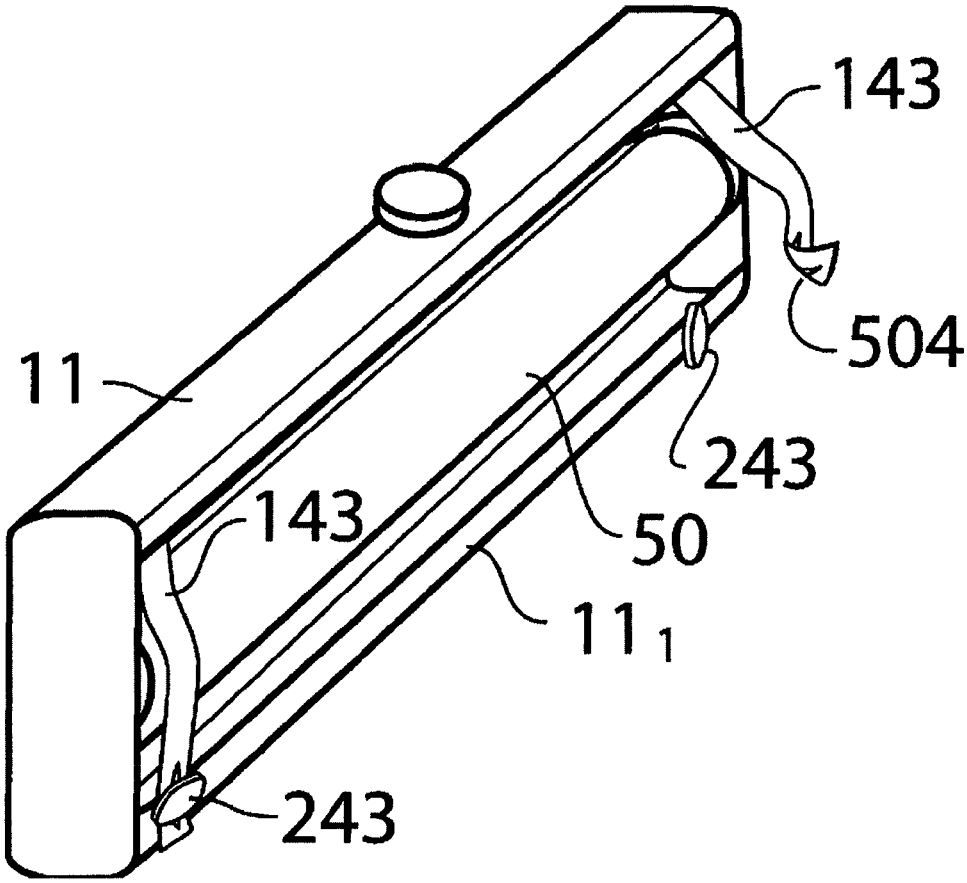
FIG. 11 is a perspective view of a sixth embodiment of the display means 1 according to the present invention.

In FIG. 11 there is disclosed a perspective view of a sixth embodiment of the display means 1 according to the present invention. In this particular embodiment, the fastening means 14 is in the form of a band 143, and the band 143 is fastened to the holding means 11 by means of a turning knob 243 arranged on the first side $\mathbf{11}_1$ of the holding means 11. Furthermore, each band 143 is provided with a slot 504 arranged to fit the turning knob 243.

Figure 12:
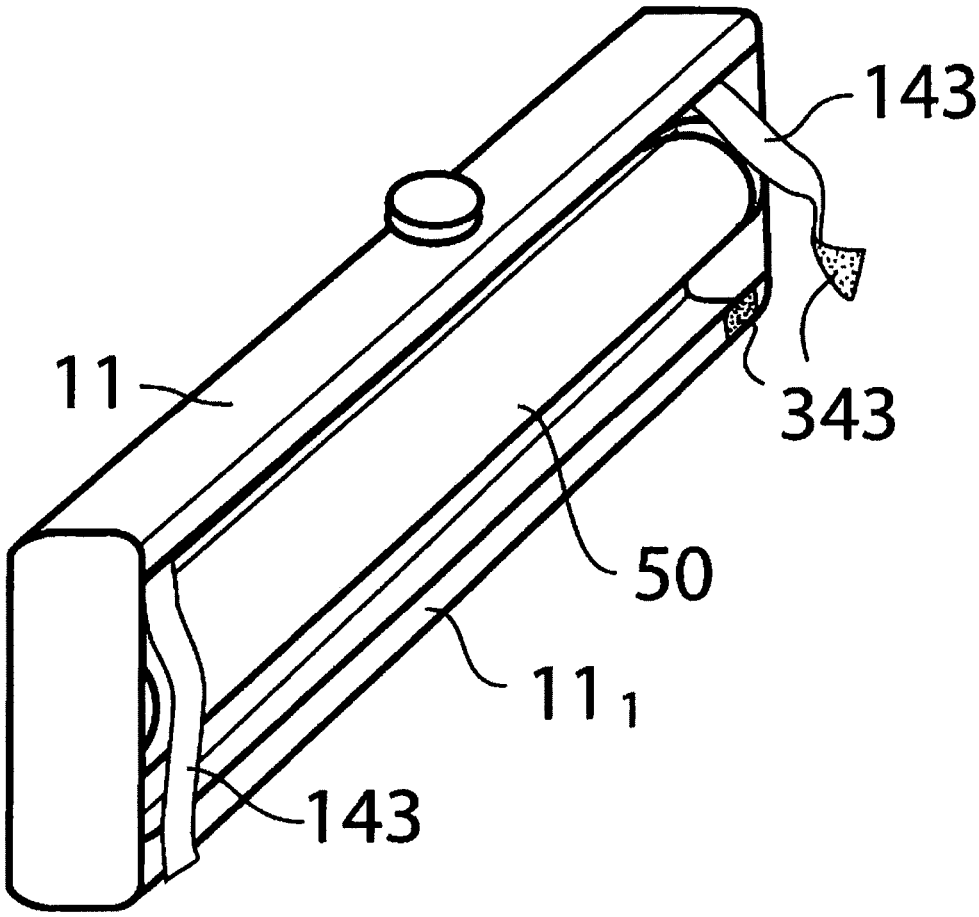
FIG. 12 is a perspective view of a seventh embodiment of the display means according to the present invention.

In FIG. 12 there is disclosed a perspective view of a seventh embodiment of the display means 1 according to the present invention. In this particular embodiment, the fastening means 14 is in the form of a band 143, and the band 143 is fastened to the holding means 11 by means of tape 343 of so called Velcro® type. As is apparent in FIG. 12, the tape 343 is arranged at the first side 11 of the holding means 11, and at the band 143.

Figure 13:
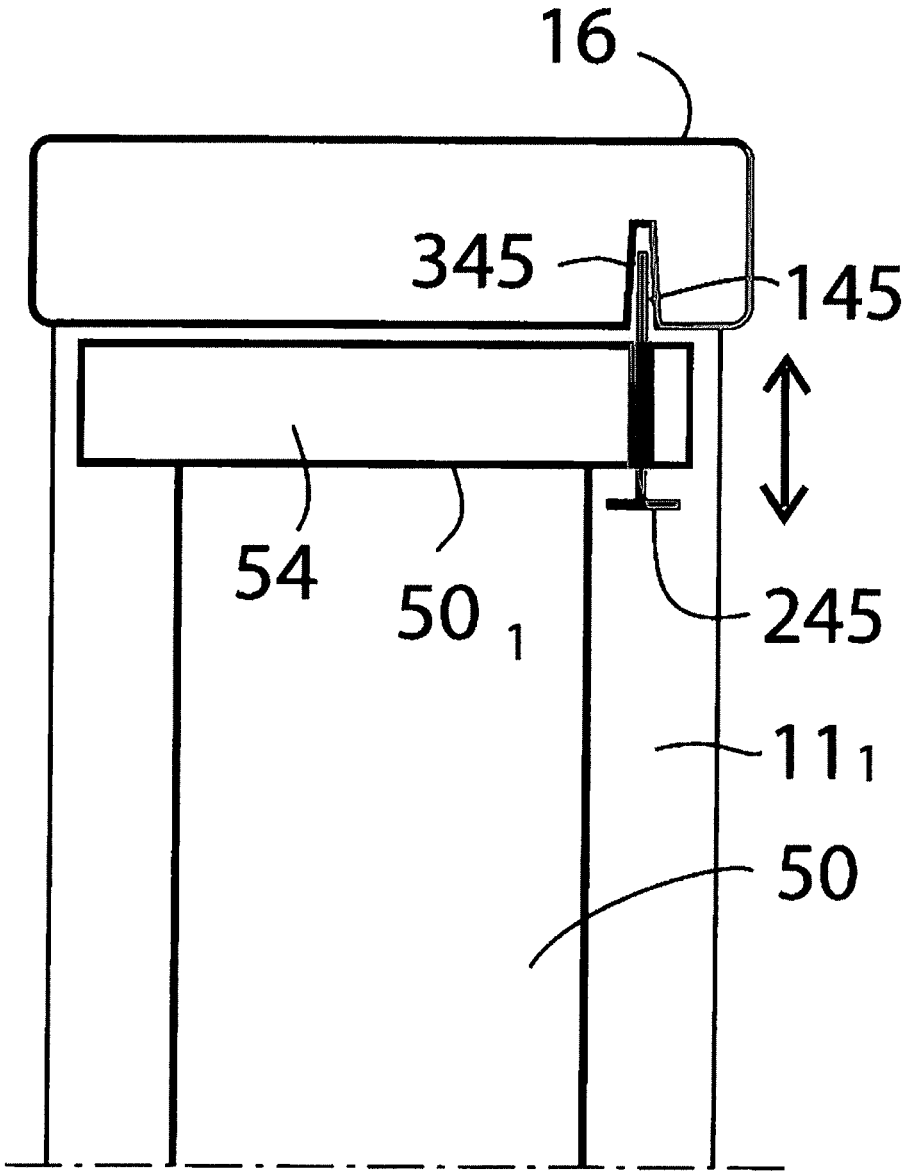
FIG. 13 is a side view of an eighth embodiment of the display means 1 according to the present invention.

In FIG. 13 there is disclosed a side view of an eighth embodiment of the display means 1 according to the present invention. In this particular embodiment, each fastening means 14 is in the form of a lock plunger means 145 provided on the end cap 54 of the cassette 50, and an actuator means 245. The actuator means 245 is operable to actuate the lock plunger means 145 between a first, inactive state (not disclosed in FIG. 13), wherein the lock plunger means 145 is in line with the end cap 54, and a second, active state (disclosed in FIG. 13), wherein the lock plunger means 145 protrudes from the end cap 54, and fits in a recess 345 provided in the end cap 16.

Figure 14:
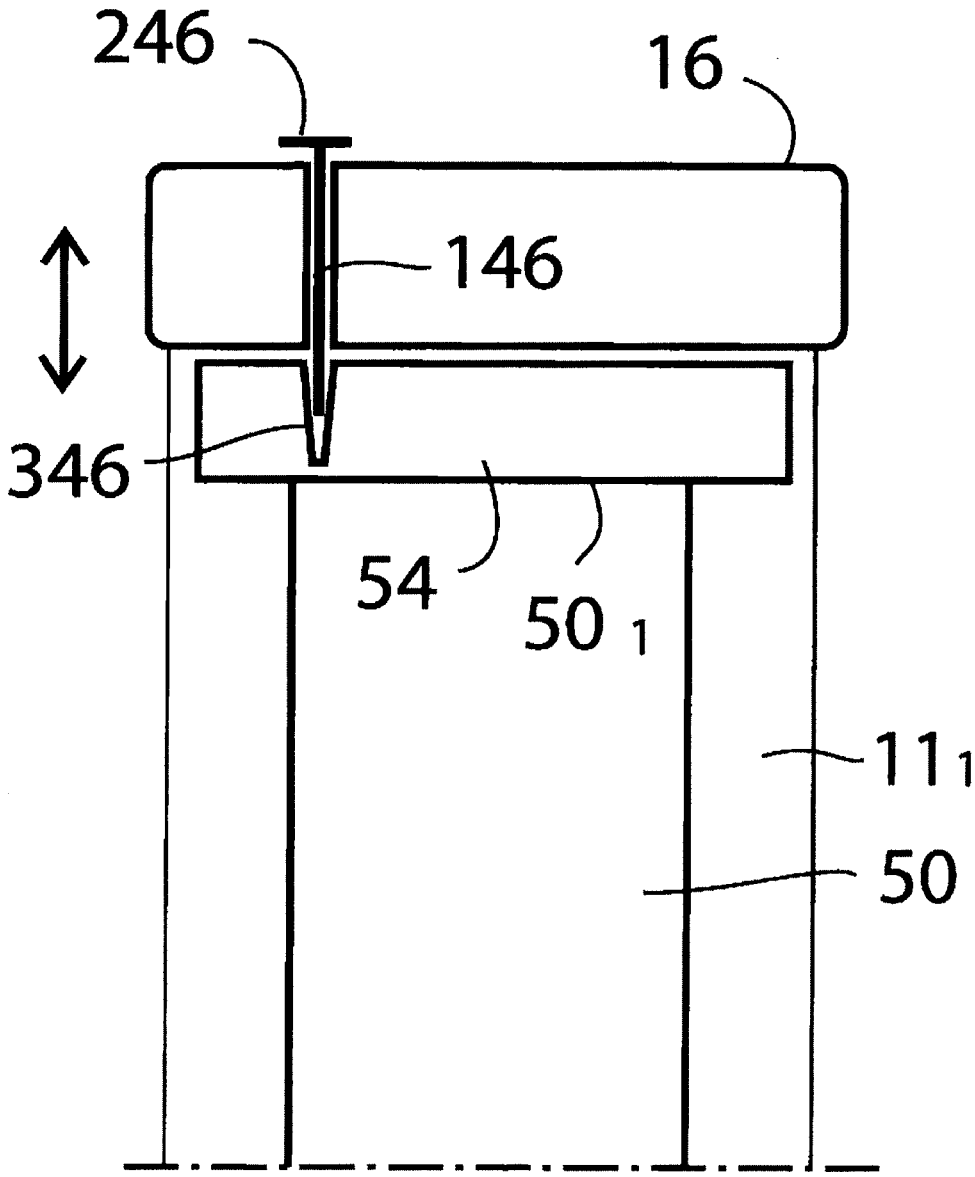
FIG. 14 is a side view of a ninth embodiment of the display means 1 according to the present invention.

In FIG. 14 there is disclosed a side view of a ninth embodiment of the display means 1 according to the present invention. In this particular embodiment, each fastening means 14 is in the form of a lock plunger means 146 provide on the end cap 16, and an actuator means 246. The actuator means 246 is operable to actuate the lock plunger means 146 between a first, inactive state (not disclosed in FIG. 14), wherein the lock plunger means 146 is in line with the end cap 16, and a second, active state (disclosed in FIG. 14), wherein the lock plunger means 146 protrudes from the end cap 16, and fits in a recess 346 provided in the end cap 54 of the cassette 50.

Figure 15:
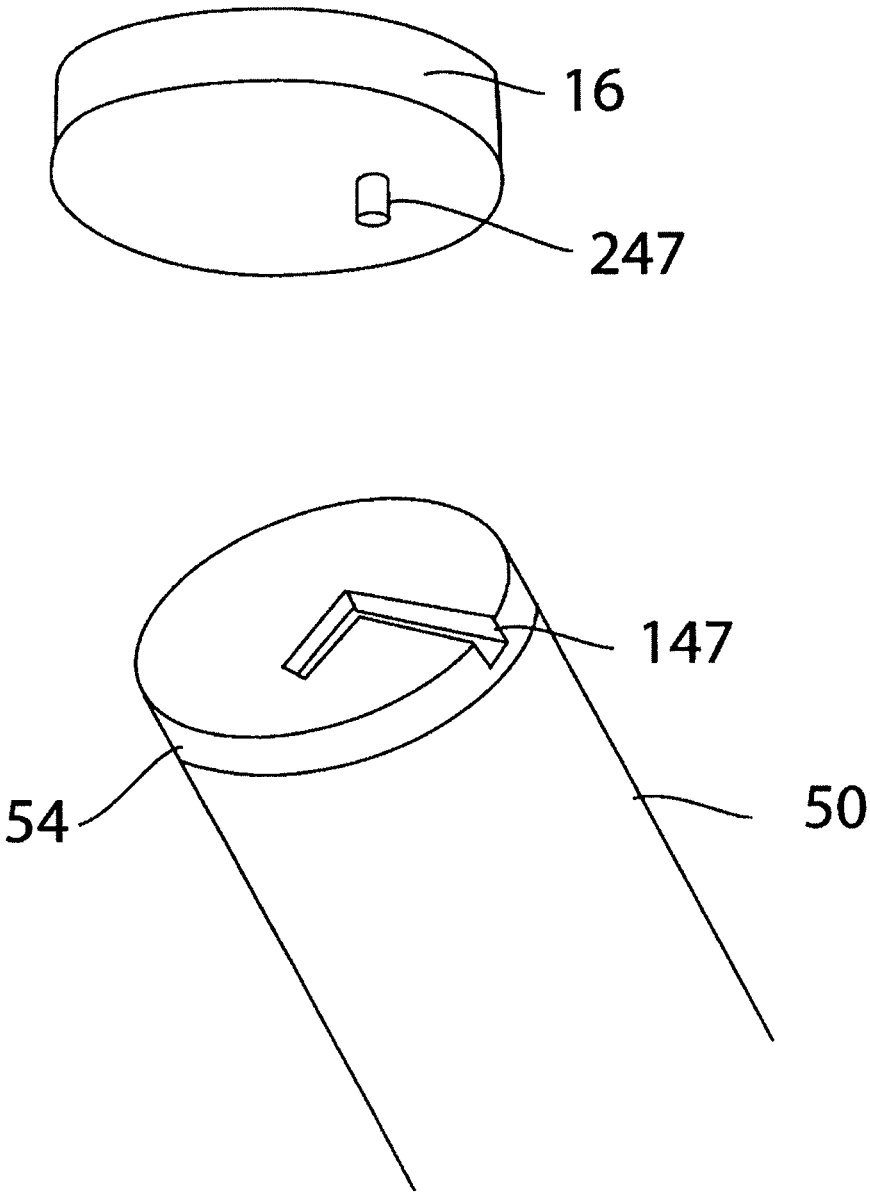
FIG. 15 is a perspective view of a tenth embodiment of the display means 1 according to the present invention.

In FIG. 15 there is disclosed a perspective view of a tenth embodiment of the display means 1 according to the present invention. In this particular embodiment, the fastening means 14 is in the form of an L shaped slot 147 provided on the end cap 54 of the cassette 50, and a protrusion means 247 provided on the end cap 16, and facing towards the aperture 13 in the holding means 11. The protrusion means 247 fits in the L shaped slot 147, and the cassette 50 being turned and moved so that the protrusion means 247 stops at the end of the L shaped slot 147.

Figure 16:
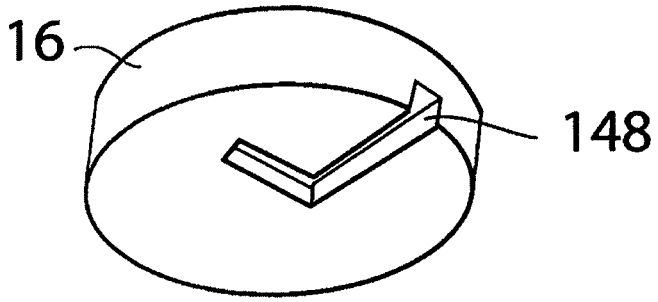
FIG. 16 is a perspective view of an eleventh embodiment of the display means 1 according to the present invention.
Figure 16:
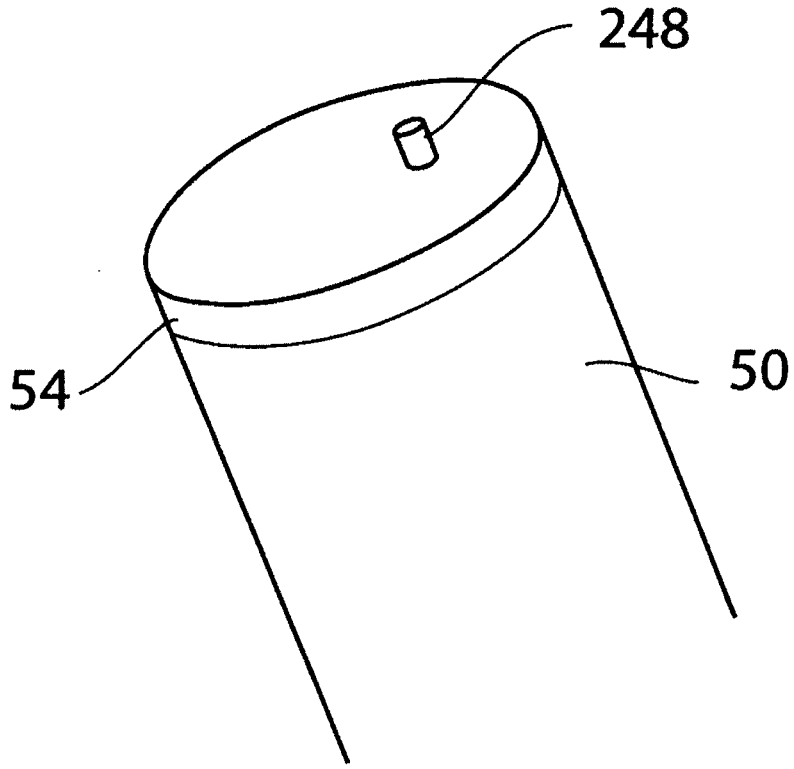

In FIG. 16 there is disclosed a perspective view of an eleventh embodiment of the display means 1 according the present invention. In this particular embodiment, the fastening means 14 is in the form of an L shaped slot 148 provided on the end cap 16, and facing towards the aperture 13 in the holding means 11, and a protrusion means 248 provided on the end cap 54 of the cassette 50. The protrusion means 248 fits in the L shaped slot 148, and the cassette 50 being turned and moved so that the protrusion means 248 stops at the end of the L shaped slot 148.

Figure 17:
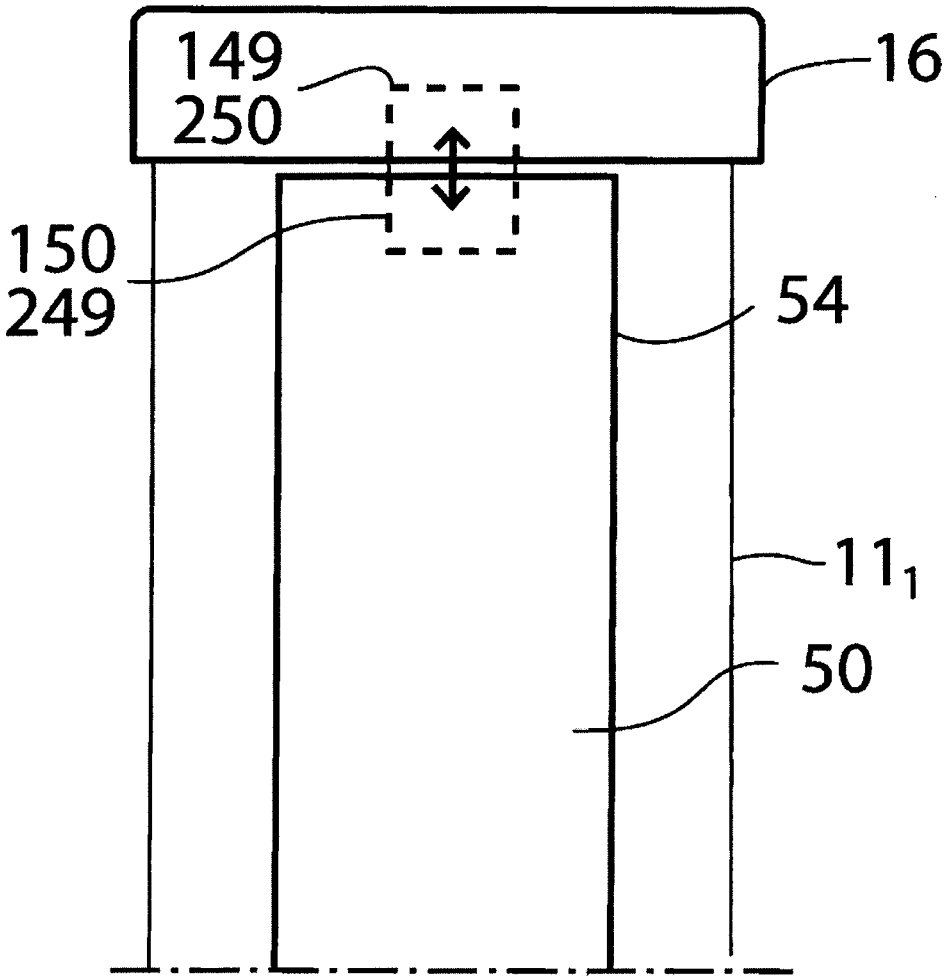
FIG. 17 is a side view illustrating both a twelfth and a thirteenth embodiment of the display means 1 according to the present invention.

In FIG. 17 there is disclosed a side view illustrating both a twelfth and a thirteenth embodiment of the display means 1 according to the present invention. In the twelfth embodiment, the fastening means 14 is in the form of a spring biased lock unger means 149 provided on the end cap 16, and facing towards the aperture 13 in the holding means 11, and a recess 249 provided in the end cap 54 of the cassette 50. When the spring biased lock plunger means 149 being released, it is operable to fit in the recess 249, locking the cassette 50 in place.

In the thirteenth embodiment, the fastening means 14 is in the form of a spring biased lock plunger means 150 provided on the end cap 54 of the cassette 50, and a recess 250 provided in the end cap 16, and facing towards the aperture 13 in the holding means 11. When the spring biased lock plunger means 150 being released, it is operable to fit in the recess 250, locking the cassette 50 in place.

The invention is not limited to the described embodiments. It will be evident for those skilled in the art that many different modifications are feasible within the scope of the following Claims.

What is claimed is:

1. A display device for a removable cassette, in which the cassette comprises a bobbin enclosed in a cavity in said cassette, comprising:

a stand adapted to display a screen, wherein said stand comprises:

a holding member, which is configured to hold said removable cassette when inserted in said stand wherein said holding member comprises:

a first side adapted to support against an underlying supportive surface, wherein said cassette is inserted into and removed from said holding member via an aperture in said first side, and at least one fastener adapted to fasten said cassette in said holding member when inserted into said holding member, wherein at least a portion of said aperture remains open when said cassette is fastened in said holding member.

2. The display device according to claim 1, wherein said fastener is in the form of holders arranged essentially perpendicular in relation to the lengthwise direction of said aperture, and said cassette when inserted into said holding member, and in that said holding member also comprises lock tabs adapted to cooperate with said holders in fastening said cassette in said holding member.

3. The display device according to claim 2, wherein said holders at least in part have a shape complementary to the shape of a part of said cassette.

4. The display device according to claim 3, wherein said cassette has a cylindrical shape.

5. The display device according to claim 2, wherein each of said holders at a first end is secured to said holding member via a hinge, and at a second end cooperates with said lock tabs in fastening said cassette in said holding member.

6. The display device according to claim 2, wherein each display device comprises two holders.

7. The display device according to claim 1, wherein each display device also comprises two holding member end caps arranged perpendicular in relation to the lengthwise direction of said holding member, and each covering an end side of said holding member.

8. The display device according to claim 7, wherein at least one of said end caps functions as said fastener in that it is a removable end cap adapted to partly cover said cassette inserted into said holding member, when said end cap is arranged on said end side.

9. The display device according to claim 8, wherein said removable end cap is arranged on, and removed from said end side by a snap joint arranged on said holding member.

10. The display device according to claim 8, wherein said removable end cap is arranged on, and removed from said end side by a bayonet joint arranged on said holding member.

11. The display device according to claim 1, wherein each fastener is in the form of a band adapted to strap said cassette into said holding member.

12. The display device according to claim 11, wherein said band is fastened to said holding member by a turning knob.

13. The display device according to claim 11, wherein said band is fastened to said holding member by tape of hooks and loops.

14. The display device according to claim 7, wherein said cassette also comprises two cassette end caps arranged perpendicular in relation to the lengthwise direction of said cassette, and each covering an end side of said cassette.

15. The display device according to claim 14, wherein said fastener is in the form of a lock plunger provided on at least one of said cassette end caps, and an actuator operable to actuate said lock plunger between a first, inactive state, wherein said lock plunger is in line with said cassette end cap, and a second, active state, wherein said lock plunger protrudes from said cassette end cap, and fits in a recess provided in said holding member end cap.

16. The display device according to claim 14, wherein said fastener is in the form of a lock plunger provided on at least one holding member end cap, and an actuator operable to actuate said lock plunger between a first, inactive state, wherein said lock plunger is in line with said holding member end cap, and a second, active state, wherein said lock plunger protrudes from said holding member end cap, and fits in a recess provided in said cassette end cap.

17. The display device according to claim 14, wherein said fastener is in the form of an L shaped slot provided on at least one of said cassette end caps, and a protrusion provided on said holding member end cap, and facing towards said aperture in said holding member, wherein said protrusion fits in said L shaped slot.

18. The display device according to claim 14, wherein said fastener is in the form of an L shaped slot provided on at least one of said holding member end caps, and facing towards said aperture in said holding member, and a protrusion provided on at least one of said cassette end caps, wherein said protrusion fits in said L shaped slot.

19. The display device according to claim 14, wherein said fastener is in the form of a spring biased lock plunger provided on said holding member end cap, and facing towards said aperture in said holding member, and a recess provided in said cassette end cap, wherein said spring biased lock plunger is operable to fit in said recess when said spring biased lock plunger is released.

20. The display device according to claim 14, wherein said fastener is in the form of a spring biased lock plunger provided on said cassette end cap, and a recess provided in said holding member end cap, and facing towards said aperture in said holding member, wherein said spring biased lock plunger is operable to fit in said recess when said spring biased lock plunger is released.

* * * * *